US011565869B2

(12) United States Patent
Ma

(10) Patent No.: US 11,565,869 B2
(45) Date of Patent: Jan. 31, 2023

(54) RECHARGEABLE PASSIVE COOLED REFRIGERATED CARGO BOX

(71) Applicant: Carrier Corporation, Palm Beach Gardens, FL (US)

(72) Inventor: Zidu Ma, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 254 days.

(21) Appl. No.: 17/024,026

(22) Filed: Sep. 17, 2020

(65) Prior Publication Data

US 2021/0086977 A1 Mar. 25, 2021

Related U.S. Application Data

(60) Provisional application No. 62/903,027, filed on Sep. 20, 2019.

(51) Int. Cl.
*B65D 81/38* (2006.01)
*B65D 81/18* (2006.01)

(52) U.S. Cl.
CPC ..... *B65D 81/382* (2013.01); *B65D 81/18* (2013.01); *B65D 81/3818* (2013.01); *F25D 2331/804* (2013.01)

(58) Field of Classification Search
CPC .. B65D 81/382; B65D 81/18; B65D 81/3818; F25D 2331/804
See application file for complete search history.

(56) References Cited

U.S. PATENT DOCUMENTS

| | | | | |
|---|---|---|---|---|
| 5,553,662 | A | 9/1996 | Longardner et al. | |
| 6,408,633 | B1 | 6/2002 | Carr | |
| 9,834,365 | B2 | 12/2017 | Pointer et al. | |
| 2003/0183375 | A1* | 10/2003 | Clarksean | F24F 5/0021 165/132 |
| 2015/0013369 | A1* | 1/2015 | Garg | B60P 3/205 62/239 |
| 2015/0314671 | A1* | 11/2015 | Vaclav et al. | B60H 1/3232 |
| 2016/0362240 | A1 | 12/2016 | Ferracamo, Jr. | |
| 2017/0082371 | A1* | 3/2017 | Vos | F28F 1/02 |
| 2017/0115042 | A1* | 4/2017 | Cantadori | F25B 45/00 |
| 2018/0283761 | A1 | 10/2018 | Büttiker | |

FOREIGN PATENT DOCUMENTS

| | | | | |
|---|---|---|---|---|
| CN | 102607308 | | 7/2012 | |
| CN | 102607308 B | * | 10/2014 | Y02E 60/142 |
| CN | 108253682 | | 7/2018 | |
| CN | 108253682 A | * | 7/2018 | F25B 41/00 |
| CN | 110030781 A | * | 7/2019 | B65D 88/745 |

(Continued)

*Primary Examiner* — Emmanuel E Duke
(74) *Attorney, Agent, or Firm* — Carlson, Gaskey & Olds, P.C.

(57) ABSTRACT

A refrigerated cargo container includes multiple exterior walls defining an exterior volume. Each of the exterior walls is thermally insulating. The container also includes multiple interior walls that define an interior volume within exterior walls. Each of the interior walls is thermally conductive. At least one fluid circuit is disposed between the plurality of exterior walls and the plurality of interior walls. The at least one fluid circuit including an inlet and an outlet and are configured to contain a super cooled fluid.

21 Claims, 4 Drawing Sheets

(56) References Cited

FOREIGN PATENT DOCUMENTS

| | | | | | |
|---|---|---|---|---|---|
| KR | 20130011288 | | | 1/2013 | |
| KR | 20130100489 | | | 9/2013 | |
| KR | 20130100489 | A | * | 9/2013 | ..... Y02E 60/145 |
| KR | 101371362 | | | 3/2014 | |
| KR | 101506187 | | | 4/2015 | |
| KR | 20150045689 | | | 4/2015 | |
| WO | WO-03085337 | A1 | * | 10/2003 | ..... F25D 11/003 |
| WO | 2016076947 | | | 5/2016 | |
| WO | 2016178911 | | | 11/2016 | |
| WO | 2017220953 | | | 12/2017 | |
| WO | 2017220954 | | | 12/2017 | |
| WO | 2018157978 | | | 9/2018 | |
| WO | 2019013636 | | | 1/2019 | |

* cited by examiner

RECHARGEABLE PASSIVE COOLED REFRIGERATED CARGO BOX

CROSS-REFERENCE TO RELATED APPLICATION

This application claims priority to U.S. Provisional Application No. 62/903027 filed on Sep. 20, 2019.

TECHNICAL FIELD

The present disclosure relates generally to refrigerated cargo box designs, and more specifically to a rechargeable passively cooled cargo box.

BACKGROUND

Cargo transportation systems, such as those utilized in air cargo shipments, are frequently used to transport temperature sensitive cargo such as medicines, perishable foods, and the like. In such cases, the cargo containers utilize either active refrigeration systems or passive cooling systems to maintain the temperature within the cargo container at or below a desired temperature. Cargo containers including an active refrigeration system are generally perceived to be more reliable and have a better capability to control the box temperature. Active refrigeration systems, however, also require more space and energy usage throughout a cargo transportation cycle.

The alternative passive cooling utilizes a phase changing material, such as ice or dry ice, to effectively cool the cargo container throughout the shipping process. The energy usage of passive systems is minimal, but the systems are more difficult to control and require a cumbersome replacement of the phase change material in between transport operations.

SUMMARY OF THE INVENTION

An exemplary refrigerated cargo container includes a plurality of exterior walls defining an exterior volume, each of the exterior walls being thermally insulating, a plurality of interior walls define an interior volume within the plurality of exterior walls, each of the interior walls being thermally conductive, and at least one fluid circuit disposed between the plurality of exterior walls and the plurality of interior walls, the at least one fluid circuit including an inlet and an outlet and being configured to contain a super cooled fluid.

In another example of the above cargo container, the at least one fluid circuit comprises at least one serpentine fluid flowpath.

In another example of any of the above cargo containers, the at least one fluid circuit comprises a plurality of cells with each cell being connected to at least one other cell via a corresponding fluid flowpath.

In another example of any of the above cargo containers, the plurality of cells are connected in series.

In another example of any of the above cargo containers, the plurality of cells are connected in parallel.

In another example of any of the above cargo containers, the plurality of cells are connected in an array.

Another example of any of the above cargo containers further includes a sensor module connected to at least one of the inlet and the outlet, wherein the sensor module includes at least one of a flowrate sensor a volume sensor and a temperature sensor.

In another example of any of the above cargo containers, the fluid circuit contains a phase change material (PCM) coolant.

In another example of any of the above cargo containers, the PCM coolant comprises a slurry of petroleum based waxes and/or a slurry of fatty acids from natural products or inorganic salt solutions.

In another example of any of the above cargo containers, the interior volume is offset from the fluid circuit such that a direct thermal path between the fluid circuit and contents of the interior volume does not exist.

An example method for recharging a passively refrigerated cargo container includes: connecting a recharge system to a cargo container, flush a spent fluid from a fluid circuit within the cargo container, injecting a super cooled fluid into the fluid circuit within the cargo container, and disconnecting the recharge system from the cargo container.

In another example of the above method, injecting the super cooled fluid causes the spent fluid to be flushed from the fluid circuit.

Another example of any of the above methods includes cooling the spent fluid, thereby converting the spent fluid into the super cooled fluid.

In another example of any of the above methods flushing the spent fluid comprises replacing the spent fluid in the fluid circuit with the super cooled fluid.

In another example of any of the above methods injecting the super cooled fluid into the fluid circuit within the cargo container is ceased in response to a temperature sensor determining that a temperature of fluid passing through a fluid circuit outlet falls below a temperature threshold.

In another example of any of the above methods injecting the super cooled fluid into the fluid circuit is ceased in response to a volume of injected super cooled fluid meeting a predefined volume threshold.

Another example of any of the above methods includes controlling the recharge system in response to a sensor output from one of a fluid circuit inlet and a fluid circuit outlet.

In another example of any of the above methods injecting the super cooled fluid comprises injecting at least one of a slurry form of phase change materials (PCMs), the PCMs being based on petroleum waxes and/or fatty acids from natural products or inorganic salt solutions.

In another example of any of the above methods flushing the spent fluid from the fluid circuit within the cargo container comprises providing the spent fluid to a storage container downstream of an evaporator.

In another example of any of the above methods injecting the super cooled fluid into the fluid circuit within the cargo container comprises injecting the super cooled fluid from a storage tank downstream of an evaporator.

These and other features of the present invention can be best understood from the following specification and drawings, the following of which is a brief description.

DETAILED DESCRIPTION

Figure 1:
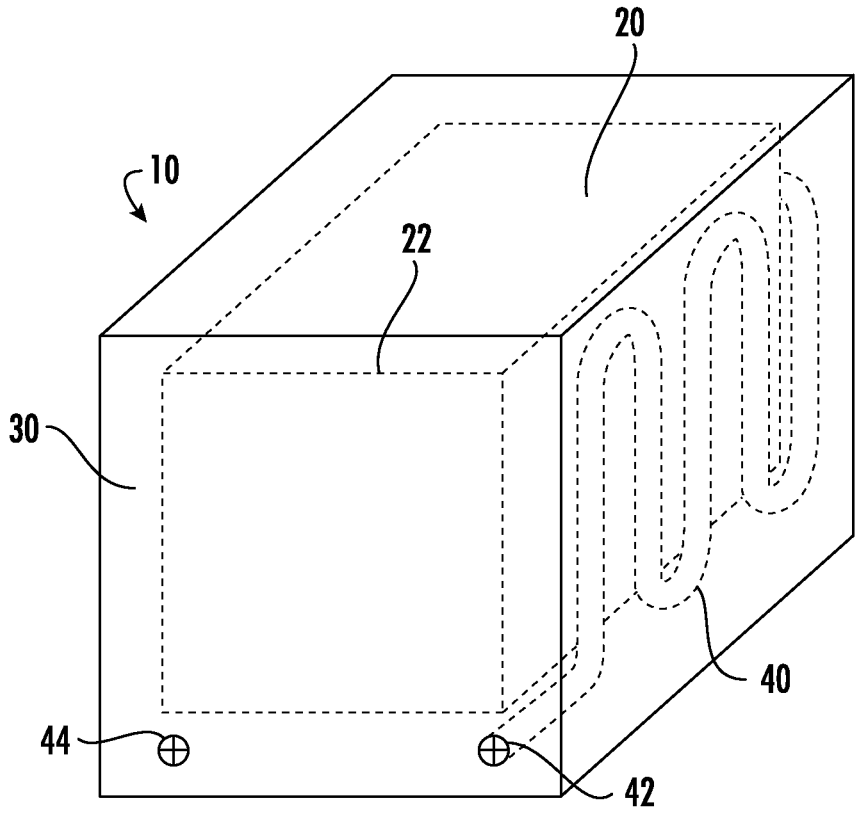
FIG. 1 illustrates a rechargeable passively cooled cargo container.

FIG. 1 schematically illustrates an exemplary cargo container 10 including an internal cavity 20 for storing cargo during shipping. The cargo container 10 is constructed of exterior walls 30, with each of the exterior walls 30 being a thermally insulating material. As used herein, thermally insulating materials refer to any material that has a heat transfer resistance (R) above 25 K/W. In some examples, the thermally insulating material has a heat transfer resistance (R) above 50 K/W. The internal cavity 20 is defined by a second set of internal walls 22, with the internal walls having a low heat transfer resistance.

Disposed between the exterior walls 30 and the internal wall 22 is a fluid circuit 40. While illustrated on only a single side of the cargo container 10 for explanatory purposes, one of skill in the art will appreciate that the fluid circuit 40 can traverse all sides of the cargo container 10. In the exemplary embodiment, the fluid circuit 40 is a serpentine flowpath, although other configurations including large cells (voids) connected by fluid flowpaths can be utilized to a similar effect.

The fluid circuit 40 includes an inlet 42 and an outlet 44 disposed on an exterior wall 30 of the cargo container 10. The inlet 42 and the outlet 44 are each configured to allow for quick connect to a recharge system, such as the recharge system illustrated in FIG. 3 and described below. The inlet 42 and outlet 44 connections can be any suitable sealed fluid connection able to allow fluid to pass through the inlet 42 and outlet 44 while connected and prevent fluid leakage while disconnected. Contained within the fluid circuit 40 is a super cooled fluid such as a super cooled slurry or super cooled liquid. Once filled with the super cooled fluid, the fluid circuit 40 maintains a cool temperature within the internal cavity 20 due to the high heat transfer coefficient of the internal walls, and the low heat transfer coefficient of the external walls, the super cooled fluid maintains the cool interior of the cargo container 10 and the inlet 42 and outlet 44 allow for the fluid to be recharged quickly, without requiring the cargo container 10 to be opened.

Figure 2:
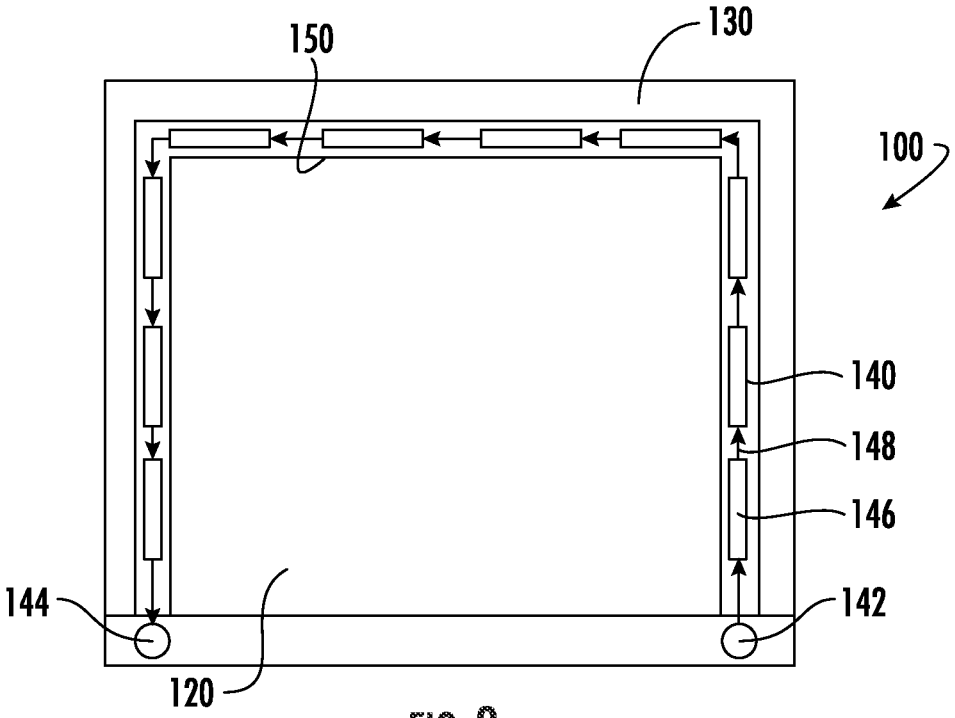
FIG. 2 schematically illustrates a cross section of an alternate embodiment rechargeable passively cooled cargo container.

With continued reference to FIG. 1, FIG. 2 schematically illustrates a cross section of an alternate embodiment cargo container 100. As with the example of FIG. 1, the cargo container 100 includes an insulated outer wall 130 with an internal cavity 120 for storing a temperature sensitive cargo. A gap is defined between a thermally conductive internal wall 150 and the thermally insulating exterior wall 130, and a cooling circuit 140 is disposed in the gap. The thermally conductive interior wall 150 isolates the internal cavity 120 from the fluid circuit 140, thereby preventing direct contact between the cargo and the fluid circuit 140.

Figure 5:
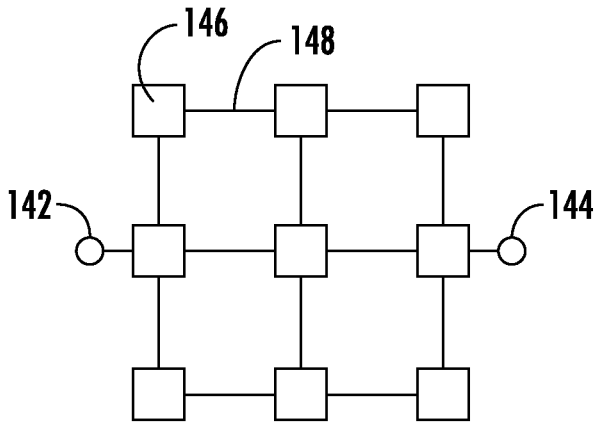
FIG. 5 schematically illustrates fluid cells arranged in an array.
Figure 6:
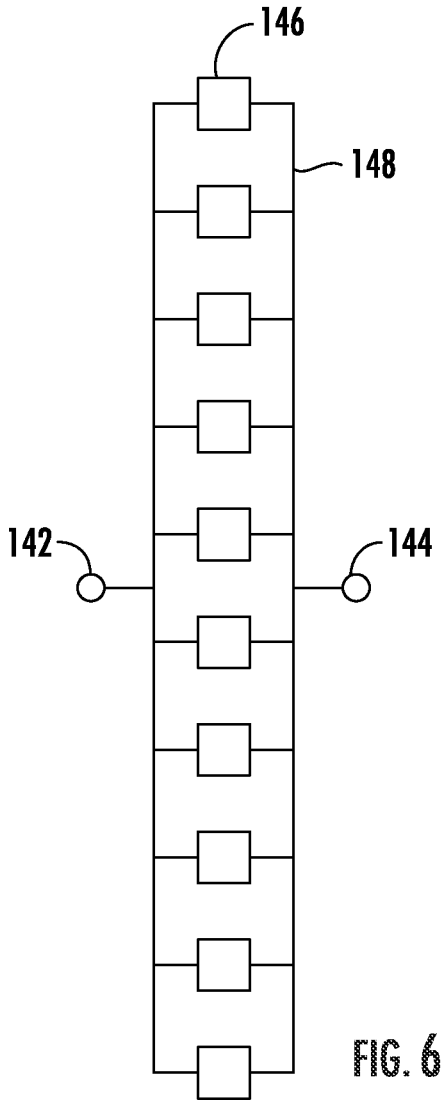
FIG. 6 schematically illustrates fluid cells arranged in parallel.

The fluid circuit 140 of FIG. 2 includes multiple cells 146 connected to each other via fluid passages 148. The fluid cells 146 can be connected in parallel (FIG. 6), in series (FIG. 2), or as an array (FIG. 5) of fluid cells 146. Each of the fluid cells 146 stores a volume of super cooled fluid and assists in maintaining the temperature in the internal cavity 120 below a threshold. Connected to the fluid circuit 140 is an inlet 142 and an outlet 144 which can be connected to a recharging circuit via any fluid transfer connection. In the illustrated example, the fluid circuit 140 does not pass through the base of the cargo container 100. In alternative examples, the fluid circuit 140 can extend through the base of the cargo container as well. Further, while illustrated as a single port connection, it is appreciated that each inlet 142 and each outlet 144 can be comprised of multiple ports disposed at distinct locations and have a similar construction. In yet further alternate embodiments, multiple fluid circuits 140 operating in the same fashion can be included without the passively cooled cargo box 100 as well.

With reference to both FIGS. 1 and 2, when the cargo container 10, 110 is initially loaded with cargo and closed, the inlet 42, 142 and the outlet 44, 144 of the fluid circuit are connected to a recharge system. The recharge system forces a super cooled fluid, such as a slurry, into the fluid circuit 40, 140. The current contents of the fluid circuit 40, 140 (e.g. spent fluid) are passed out the outlet 44, 144. In some examples, the super cooled fluid can be any of a slurry of phase change materials (PCM) such as a slurry of petroleum based waxes and/or a slurry of fatty acids from natural products or inorganic salt solutions, or a mixture of heat transfer fluid with encapsulated PCM particles. During the insertion, a controller (illustrated in FIG. 3) can determine that sufficient super cooled fluid has been inserted that the spent fluid is flushed out by determining a volume of fluid that has been injected into the fluid circuit 40, 140, a volume of fluid that has exited the outlet 44, 144, measuring a temperature of the fluid exiting the outlet 44, 144, or measuring a flow rate of fluid exiting the outlet 44, 144.

Once the fluid circuit has been recharged in this manner, the fluid circuit is able to provide a cooled internal environment within the cargo box for a predetermined length of time. With the length of time being dependent on the insulation of the exterior walls, the temperature of the super cooled fluid, and a volume of cargo within the container. The length of time can be determined via testing using any testing methodology.

Figure 3:
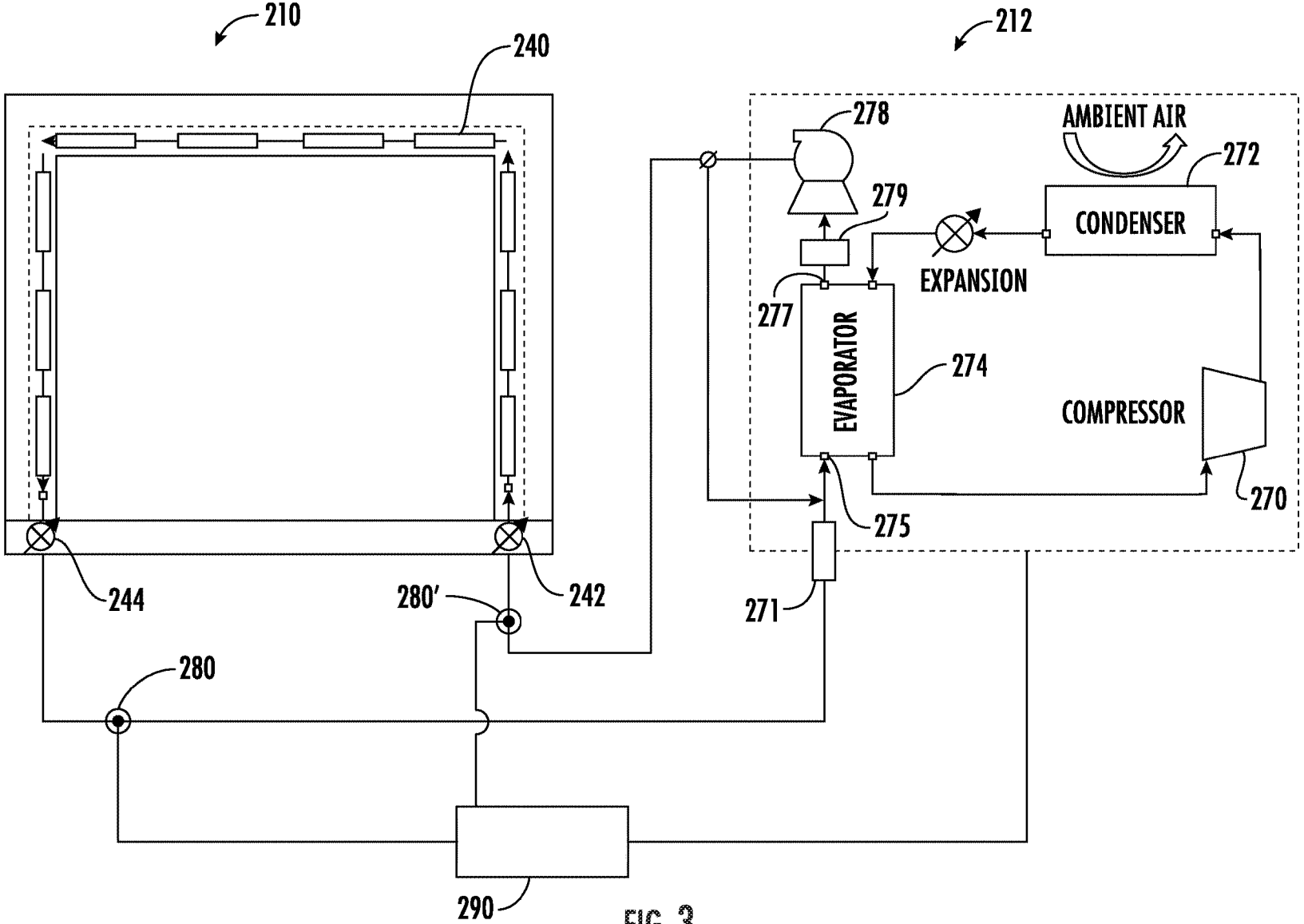
FIG. 3 illustrates an exemplary rechargeable passively cooled system connected to a recharging system.
Figure 4:
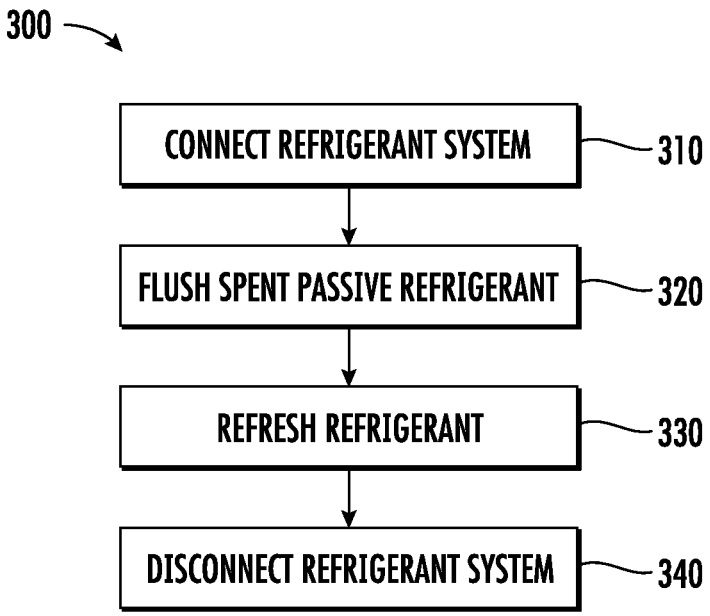
FIG. 4 illustrates a method for refreshing a coolant in the rechargeable passively cooled cargo container of FIGS. 1 and 2.

With continued reference to FIGS. 1 and 2, and with like numerals indicating like elements, FIG. 3 schematically illustrates an exemplary passively cooled cargo box 210 connected to a recharge system 212 in order to recharge the fluid in the fluid circuit 240. The exemplary recharge system 212 includes a compressor 270 that compresses a coolant, and provides the compressed coolant to a condenser 272. The condensed coolant is expanded and provided to an evaporator 274, where the coolant is used to super cool a fluid for insertion into the cargo box 210 fluid circuit 240. The coolant is then provided from the evaporator 274 back to an inlet of the compressor 270 and the cycle continues. In alternative examples alternative systems for cooling the coolant used to super cool the fluid circuit fluid can be utilized to similar effect.

The evaporator 274 also includes an inlet 275 that accepts spent fluid from the outlet 244 of the fluid circuit 240. The spent fluid is passed into the evaporator 274 as super cooled fluid is passed out of the evaporator via an outlet 277. The outlet 277 is connected to the inlet 242 of the fluid circuit 240 via a fluid driver 278. In some examples, the evaporator 274 can be a reservoir that is filled with super cooled fluid prior to connecting to the inlet 242 and outlet 244. In alternative examples, the act of passing the spent fluid through the evaporator 274 super cools the fluid and the same fluid is re-inserted into the fluid circuit 240 during a recharge operation. In some examples, such as those where the capacity of the recharge system 212 is smaller than the volume of super cooled fluid that is extracted from the cargo box 210, two additional storage tanks 271, 279 are included. A first storage tank 271 is positioned immediately upstream of the evaporator and stores the spent fluid, while the second storage tank 279 is positioned downstream of the evaporator and stores super cooled fluid prior to the super cooled fluid being returned to the cargo box 210.

In some systems, it can be desirable to pre-cool a storage tank 279 of super cooled fluid, prior to connecting the recharge system 212 to the cargo box 210. Such a system can be facilitated by a fluid loop connecting the second storage tank 2709 to the inlet of the evaporator 274, and driving the fluid through the evaporator 274, thereby filling the second fluid tank 279 with a super cooled fluid. This in turn allows for a quick recharge where the spent fluid from the cargo box 210 is drawn into the first storage tank 271 and the precooled fluid form the second storage tank 279 is driven into the cargo box 210 without waiting for the spent cooling fluid to be recharged.

At one or both of the inlet 242 and outlet 244 is a sensor module 280, 280'. The sensor module(s) 280, 280' include one or more of a temperature sensor configured to sense the temperature of the fluid at the sensor location, a flow rate sensor, a volume sensor configured to detect a volume of fluid passing through the sensor, or any similar sensor. Each of the sensors is connected to a controller 290, and the controller 290 is configured to control the cooling and injection operations of the recharge system 212.

With continued reference to FIGS. 1-3, FIG. 4 schematically illustrates an exemplary method 300 for recharging a passively cooled cargo box, such as the cargo boxes 10, 100 of FIGS. 1 and 2. Initially, when the cargo box 10, 100 has reached the end, or is nearing the end, of a current cooling fluid charge, the cargo box 10, 100 is connected to a recharge system, such as the recharge system 212 of FIG. 3, in a "Connect refrigerant system" step 310. In some examples, the recharge system 212 includes sensor modules 280, 280' on the connections. In alternative systems, the sensor modules 280, 280' can be included within the cargo box 10, 100 and the sensor modules 280, 280' are also connected to the recharge system 212 controller 290 in the connect refrigerant system step 310.

Once the inlet 42, 142 and the outlet 44, 144 are connected to the recharge system 212, the spent (warm) fluid is flushed from the fluid circuit 40, 140 and provided to the recharge circuit in a "Flush Spent Passive Refrigerant" step 320. The spent passive refrigerant fluid is replaced with super cooled fluid in a "Refresh Refrigerant" step 330. In some examples, the replacement fluid is used to force the spent fluid out of the fluid circuit 40, 140. In alternative examples, another system can force the fluid out of the fluid circuit 40, 140, and the spent fluid can be re-cooled in the evaporator 274 and returned to the fluid circuit 40, 140.

Once the fluid circuit 40, 140 has been refilled, or the super cooled fluid has sufficiently supplanted the fluid in the fluid circuit 40, 140, the recharge system is turned off and disconnected in a "Disconnect Refrigerant System" step 340. In some examples the controller 290 can determine that the fluid has been sufficiently supplanted by comparing a temperature of the fluid exiting the outlet 44, 144 against a threshold temperature and determining that the fluid has sufficiently been supplanted when the temperature falls below the threshold. In another example, the volume within the fluid circuit is a known quantity, and the controller 290 can determine that the fluid has sufficiently been supplanted when the known volume of super cooled fluid has been inserted into the fluid circuit 40, 140. In another example, the flowrate of the fluid exiting the system can be utilized alone, or in combination with another factor to determine that the fluid has been sufficiently supplanted via the super cooled fluid.

It is appreciated that, depending on the cargo being transported, and the necessary temperatures of the internal cavity, a system can be created where less than 100% of the spent fluid is supplanted. Similarly, a system can be created, where more than 100% is supplanted (e.g. a portion of the initially inserted super cooled fluid is also allowed to exit the fluid circuit 40, 140) in order to ensure maximum cooling within the internal cavity.

The system disclosed herein has a decreased recharge time and decreased complexity relative to existing passively cooled systems and provides a substantial improvement on the ability to regulate temperatures within a passively cooled cargo box. In addition, high latent heat phase change materials (PCMs) can be used in the super cooled fluid which decreases the overall weight of the system.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerated cargo container comprising:

a plurality of exterior walls defining an exterior volume, each of the exterior walls being thermally insulating;

a plurality of interior walls define an interior volume within the plurality of exterior walls, each of the interior walls being thermally conductive;

at least one fluid circuit disposed between the plurality of exterior walls and the plurality of interior walls, the at least one fluid circuit including an inlet and an outlet and being configured to contain a super cooled fluid; and a controller configured to determine that a sufficient magnitude of super cooled fluid has been inserted into the fluid circuit that a spent fluid has been flushed out of the fluid circuit.

2. The refrigerated cargo container of claim 1, wherein the at least one fluid circuit comprises at least one serpentine fluid flowpath.

3. The refrigerated cargo container of claim 1, wherein the at least one fluid circuit comprises a plurality of cells with each cell being connected to at least one other cell via a corresponding fluid flowpath.

4. The refrigerated cargo container of claim 3, wherein the plurality of cells are connected in series.

5. The refrigerated cargo container of claim 3, wherein the plurality of cells are connected in parallel.

6. The refrigerated cargo container of claim 3, wherein the plurality of cells are connected in an array.

7. The refrigerated cargo container of claim 1, further comprising a sensor module connected to at least one of the inlet and the outlet, wherein the sensor module includes at least one of a flowrate sensor a volume sensor and a temperature sensor.

8. The refrigerated cargo container of claim 1, wherein the fluid circuit contains a phase change material (PCM) coolant.

9. The refrigerated cargo container of claim 8, wherein the PCM coolant comprises a slurry of petroleum based waxes and/or a slurry of fatty acids from natural products or inorganic salt solutions.

10. The refrigerated cargo container of claim 1, wherein the interior volume is offset from the fluid circuit such that a direct thermal path between the fluid circuit and contents of the interior volume does not exist.

11. The refrigerated cargo container of claim 1, wherein the controller is configured to determine that the sufficient magnitude of super cooled fluid has been inserted into the fluid circuit by at least one of determining a volume of fluid injected into the fluid circuit, determining a volume of fluid that has exited the fluid circuit, measuring a temperature of fluid exiting the fluid circuit, and measuring a flow rate of fluid exiting the fluid circuit.

12. A method for recharging a passively refrigerated cargo container comprising:

connecting a recharge system to a cargo container;

flushing a spent fluid from a fluid circuit within the cargo container;

injecting a super cooled fluid into the fluid circuit within the cargo container; and disconnecting the recharge system from the cargo container.

13. The method of claim 12, wherein injecting the super cooled fluid causes the spent fluid to be flushed from the fluid circuit.

14. The method of claim 12, further comprising cooling the spent fluid, thereby converting the spent fluid into the super cooled fluid.

15. The method of claim 12, wherein flushing the spent fluid comprises replacing the spent fluid in the fluid circuit with the super cooled fluid.

16. The method of claim 12, wherein injecting the super cooled fluid into the fluid circuit within the cargo container is ceased in response to a temperature sensor determining that a temperature of fluid passing through a fluid circuit outlet falls below a temperature threshold.

17. The method of claim 12, wherein injecting the super cooled fluid into the fluid circuit is ceased in response to a volume of injected super cooled fluid meeting a predefined volume threshold.

18. The method of claim 12, further comprising controlling the recharge system in response to a sensor output from one of a fluid circuit inlet and a fluid circuit outlet.

19. The method of claim 12, wherein injecting the super cooled fluid comprises injecting at least one of a slurry form of phase change materials (PCMs), the PCMs being based on petroleum waxes and/or fatty acids from natural products or inorganic salt solutions.

20. The method of claim 12, wherein flushing the spent fluid from the fluid circuit within the cargo container comprises providing the spent fluid to a storage container downstream of an evaporator.

21. The method of claim 12, wherein injecting the super cooled fluid into the fluid circuit within the cargo container comprises injecting the super cooled fluid from a storage tank downstream of an evaporator.

* * * * *